US012773034B2

(12) United States Patent
Cole et al.

(10) Patent No.: US 12,773,034 B2
(45) Date of Patent: Oct. 27, 2026

(54) FOOTWEAR ASSEMBLY INCLUDING SHAPE MEMORY ALLOY ELEMENTS

(71) Applicant: Nitiwear, Inc., Dover, DE (US)

(72) Inventors: Earl Cole, Studio City, CA (US); Brian Yennie, Upland, CA (US); Charles Weinberg, Boston, MA (US)

(73) Assignee: NITIWEAR, INC., Dover, DE (US)

( * ) Notice: Subject to any disclaimer, the term of this patent is extended or adjusted under 35 U.S.C. 154(b) by 0 days.

(21) Appl. No.: 18/749,983

(22) Filed: Jun. 21, 2024

(65) Prior Publication Data

US 2024/0423320 A1 Dec. 26, 2024

Related U.S. Application Data

(60) Provisional application No. 63/522,803, filed on Jun. 23, 2023.

(51) Int. Cl.
*A43B 13/18* (2006.01)
*A43B 3/10* (2006.01)

(52) U.S. Cl.
CPC ..... *A43B 13/187* (2013.01); *A43B 3/10* (2013.01)

(58) Field of Classification Search
CPC ..... A43B 1/08; A43B 13/02; A43B 13/10; A43B 13/187
See application file for complete search history.

(56) References Cited

U.S. PATENT DOCUMENTS

2012/0023686 A1* 2/2012 Huffa ..... A43D 3/00 12/145
2021/0186148 A1* 6/2021 Christensen ..... A43B 13/181
2024/0116313 A1 4/2024 Yennie

FOREIGN PATENT DOCUMENTS

CN 2419851 Y * 2/2001
JP H0686515 * 12/1994
JP H0686527 * 12/1994
KR 20110000743 U * 1/2011

OTHER PUBLICATIONS 4 pages of English Translation of CN 2419851 (Year: 2001).*
5 pages of English Translation of JP H0686515 (Year: 1994).*
6 pages of English Translation of JP H0686527 (Year: 1994).*
5 pages of English Translation of KR 20110000743 (Year: 2011).*

* cited by examiner

*Primary Examiner* — Ted Kavanaugh
(74) *Attorney, Agent, or Firm* — Jeffer Mangels & Mitchell LLP; Brennan C. Swain, Esq.

(57) ABSTRACT

An article of footwear that includes an upper and at least one of an insole, midsole or outer sole having a shape memory alloy element associated therewith. The shape memory alloy elements may be molded into the midsole, positioned between the midsole and outsole or incorporated into another portion of the article of footwear. The shape memory alloy elements may be tuned, prestrained or prestressed in a fixture prior to incorporation in the article of footwear.

7 Claims, 8 Drawing Sheets

FOOTWEAR ASSEMBLY INCLUDING SHAPE MEMORY ALLOY ELEMENTS

CROSS REFERENCE TO RELATED APPLICATIONS

This application claims the benefit of U.S. Patent Application No. 63/522,803, filed Jun. 23, 2023, the entirety of which is incorporated by reference herein.

FIELD OF THE INVENTION

The present invention relates to shape memory alloys ("SMAs"), particularly to SMAs being used in footwear.

BACKGROUND OF THE INVENTION

Current popular midsole solutions in the footwear industry involve using foam. However, three major issues persist with this solution, which include limited rebound energy, compression setting degrades performance and lifetime and mechanical properties degrade with increased temperature during usage. The present invention may address one or all of these issues.

The background description disclosed anywhere in this patent application includes information that may be useful in understanding the present invention. It is not an admission that any of the information provided herein is prior art or relevant to the presently claimed invention, or that any publication specifically or implicitly referenced is prior art.

SUMMARY OF THE PREFERRED EMBODIMENTS

In accordance with a first aspect of the present invention there is provided, an article of footwear that includes an upper and at least one of an insole, midsole or outer sole. At least one of the insole, midsole or outer sole includes a shape memory alloy element associated therewith. The shape memory alloy element may be formed via a fixture prior to inclusion in the article of footwear.

The present invention is directed to novel integrations of superelastic shape memory alloys within footwear (e.g., outer sole, midsole, insole, upper) and different methods for accomplishing this integration. The integration of SMA within footwear may be used, for example, to increase lifetime, rebound energy, potentially damping abilities, and reduce negative impacts from compression set and heat in current footwear foam/polymer solutions.

As will be appreciated by those of skill in the art, SMAs, such as nickel-titanium (Nitinol/NiTi) are a class of metal alloys that leverage a solid-state phase transformation to enable a unique set of functional properties, such as superelasticity (SE). The superelastic solid-state phase transformations occur when the material is stressed to a monoclinic B19' detwinned stress-induced martensite phase from a B2 cubic austenite. Upon unloading at environmental temperatures above the characteristic transformation temperature, Austenite Finish, the material will undergo the reverse transformation back to Austenite. SE allows SMAs to recover up to 10-12.0% structural strain, an unmatched phenomenon in metal-based material systems. The unique functional properties of SE, combined with desirable mechanical properties (high stiffness, enhanced damping, corrosion resistance, energy return), make SMAs well suited for many applications.

In a preferred embodiment, the SMA structure is encapsulated within polymer for footwear. The polymer may include a rubber compound, foam compound, or combination of rubber and foam. The polymer encapsulation provides shear/lateral structural integrity, and improves vertical structural integrity. In a preferred embodiment, the SMA structure is shape-set before encapsulation. This may be a beneficial manufacturing step for optimal performance. However, this is not a limitation on the present invention. The composite structure may be used for or in the insole, midsole, orthotics, and/or outersoles or outsoles.

The SMA structure may comprise an elongate structure (e.g., wire, ribbon/strip, tube, yarn, microfilament, etc.) and is shape set in a final structure for encapsulation. The design of the structure is not limited to a single concept, shape or configuration. Some structural design examples, shapes or configurations include canted and vertical coils/springs, circular, non-circular, leaf springs, cantilevered beam springs, wave springs, arches, coiled arches, 3D woven, interwoven springs, 3D knit, braids, laser cut tubes (similar to stents) and buckling columns.

In a preferred embodiment, the SMA elongates are pre-strained and then encapsulated within a secondary material to lock in the pre-strain. It will be appreciated by those of ordinary skill in the art that the energy absorption capabilities of SMA are or may be improved at some level of pre-strain (or pre-stress). The present invention utilizes pre-straining to create a composite material with a strong balance of rebound energy and energy absorption that may be used for footwear as midsoles, insoles or outer soles, among other structure. The composite may remain planar (i.e, 2D) or be stacked in a 3D configuration (similar to carbon fiber composite sheets).

In the present invention, a section of footwear is comprised mainly of a fabric consisting of shape memory alloy elongate. Other materials can be used in the interlocking fabric structure. Examples include compressed knitted/woven mesh, where knitted/woven textiles are crushed into a compressed mesh, 3D knitted textile (excluding spacer fabrics), and/or 3D woven textile, such as hexagonal woven.

In a preferred embodiment, the present invention includes inserting a semi-crushed superelastic SMA structure within a cavity. Upon release, the structure self-expands, filling the cavity and providing structural integrity. In some cases, the SMA structure may be cooled below Martensitic Finish Transformation Temperature so that it can be crushed and loaded in the deployment system. The SMA structure is fixed in place by the outward force on the cavity wall from its self-expansion. This can be combined with the embodiment described above, where the inner cavity is then filled with more polymer/foam for further encapsulation.

As discussed above, current popular midsole solutions in the footwear industry involve using foam. However, three major issues persist with this solution, which include limited rebound energy, compression setting degrades performance and lifetime and mechanical properties degrade with increased temperature during usage. The integration of superelastic SMA into footwear may alleviate one or all of these problems. SMA has instantaneous or fast strain recovery associated with large spring-back forces. The metallic nature of the alloy enable it to resist compression set and adverse effects from increased heat. At higher temperatures, the plateau strength of SMA increases and strengthens the material.

A preferred embodiment is embodied in an SMA assembly. The SMA assembly includes and SMA structure. The SMA structure is encased in a polymer. The SMA structure includes an SMA element.

This and other embodiments may optionally include the following. The SMA element may include at least one of NiTi, Ag—Cd, Au—Cd, Cu—Al—Ni, Cu—Sn, Cu—Zn, Fe—Pt, Mn—Cu, Fe—Mn—Si, Co—Ni—Al, Co—Ni—Ga, Ni—Fe—Ga, Ti—Nb, B—Ti alloys, ternary alloys, or quaternary alloys of a material of the SMA element. The SMA element, elongate, member, component, portion or the like may be a wire, sheet, spring, or foam.

The SMA element may be multiple SMA elements. The SMA elements may be mechanically combined. The multiple SMA elements may include multiple springs that may be interwoven with each other. The multiple SMA elements may include a spring and a wire. The spring and the wire may be interwoven with each other. The multiple SMA elements may be arranged to form a helical or toroidal shape.

The present invention may be embodied in a semi-rigid SMA/polymer composite plate for a midsole insert. The midsole insert can be used, for example, in the performance athletic shoe industry. The midsole insert may include a semi-rigid plate/structure integrated within the midsole to add return energy, propulsion, and directionality during running. A semi-rigid or rigid SMA composite may be used for this application. The SMA component design may include SMA elongates (wires, ribbon, microfilaments, yarns, tubing), SMA sheet, chopped (short-length) SMA elongates (chopped fiber, chopped wire, etc.), SMA fabrics (wovens, knits). The SMA may be either shape-set in a 3D rigid plate geometry and then added to a semi-rigid matrix or the SMA may be added to the semi-rigid matrix from the straight-annealed or pre-fabricated (fabrics) condition.

The present invention may be embodied in a SMA spike or spikes for cleated footwear, such as baseball cleats or track cleats. Rigid metallic spikes in baseball footwear pose an injury to the user. With little to no give in the spike during usage, the user must compensate with muscles and joints which can result in injury. For example, a common form of knee damage is from buckling/giving of the knee while the foot is rigidly spiked into the ground, typically resulting in ligament damage. A more compliant superelastic SMA spike may benefit the user in traction, propulsion/rebound energy, and injury prevention, as well as better corrosion and wear resistance.

With respect to SMA spikes for track cleat footwear, a superelastic SMA spike for track & field footwear may offer the user multiple benefits including better propulsion/return energy, sharper edges for better traction, and injury prevention, propulsion/rebound energy, better corrosion and wear resistance, and lightweighting.

In another preferred embodiment, an SMA assembly for use in footwear or other areas can be created by knitting, weaving, compressing, crushing, etc. SMA elements together with another material and/or fibers, strands or portions of one or more materials to create an SMA fabric. In short, the invention includes weaving, knitting or incorporating SMA wires or elements with other fibers or the like to create a fabric that includes SMA elements therein. Exemplary shapes that can be created using SMA elements within a knitted, weaved, crushed or other type of material include any polygon, such as hexagons, rectangles, triangles, etc. Any shape is within the scope of the present invention.

3D fabrics comprised of interlocking/interwoven SMA elongates can be manufactured for footwear components. Secondary materials can also be used within the fabric for interlocking/interweaving and holding the SMA in shape. Exemplary types of SMA fabrics for footwear include: 3D woven fabrics, which are woven fabrics that include interwoven filaments/elongates that hold the structure together. 3D knitted fabrics, which are knitted fabrics that include interlocking filaments/elongates that hold the structure together. There are many types of 3D knitted fabrics suitable for footwear components. Compressed Mesh, which includes 2D woven or knitted fabrics that are then rolled/folded and crushed into a compressed mesh form. For example, the shapes may include hexagonal 3D woven fabric, 3D tactile knit, and compressed mesh.

In some cases, the usage of a sacrificial filament material may be used in manufacturing to guide the SMA into the interlocking or interwoven structure. After fabric manufacturing, the sacrificial material may be removed or destroyed leaving just the SMA. Shape setting and stress relieving. Post processing of the SMA fabric may involve shape setting the fabric into a custom geometry as well as stress relieving the material and induced manufacturing stresses. Any of the SMA fabrics are assemblies discussed herein can be utilized in footwear.

In another preferred embodiment, the SMA elements in a predetermined shape may be delivered or placed within a space, hollow or recess within the footwear (e.g., within a portion of the shoe, such as the midsole, insole, outersole or between any of these component or other components of the article of footwear, etc.). Stent delivery systems are often used for delivering stents or other components that comprise an SMA material and then allowing the stent to expand when removed from the delivery device, such as a catheter, sheath or the like. A similar system can be used to deliver the SMA elements or assembly to a location within the footwear.

The present invention includes a novel manufacturing method for footwear components composed of SMA utilizing similar methods to those of stent delivery systems used in medical devices. In use, the SMA structure is crushed, constricted or the like into a smaller form or smaller cross-sectional area. This may be done at temperatures below Martensitic Finish temperature for easier deformability of the SMA structure. In its crushed form, a sheath or shell is placed around the SMA structure to hold it in shape. The sheath is loaded in the delivery system. The delivery system for the SMA structure is designed to fit within the footwear component cavity and deploy the SMA structure out of the sheath. The SMA structure then self-expands, filling the cavity. The outward force on the cavity walls from the SMA holds the SMA in its place. The cavity is defined within the footwear component where the SMA structure is or will be deployed. This cavity can be grooved for guides for the SMA wire to fall into a specific geometry. Additionally, the cavity can be filled after the SMA structure is disposed in the desired location for further encapsulation of the SMA structure. The SMA structure may include a cylindrical shape like a stent and may be movable between a constricted form, shape or state and a fully expanded state.

In a preferred embodiment, SMA elements or SMA may be associated with or included in cleats or spikes as part of an article of footwear (e.g., protruding from the outsole or outer sole). The spikes that include SMA elements may take any shape. For example, baseball spikes are typically in a bent plate configuration, similar to an L-shape. Spikes that comprise SMA may be a similar geometry as the L-shape (or may be another shape) and may be manufactured in multiple ways. EDM cutting may be used. In using EDM cutting, the final geometry may be cut from an SMA plate using an EDM machine. Die pressing may be used. The bent geometry or the spike may be formed using a die press. The SMA may remain constrained and then shape set. Hot forming may be used. This may be similar to die pressing, as described above, but at elevated temperatures to possibly remove the secondary shape-setting step. After being formed, the SMA spikes may then be fixed, secured or attached to or within the outer sole of the footwear.

Different types of spikes may be used with or in an article of footwear that may be used for any type of desired activity, such as track related activities. In a preferred embodiment, each of these types of spikes (or other shaped spikes or cleats) can include SMA associated therewith. For example, track and field spikes may be found in four geometries: needle, pyramid, tartan and tree configurations. The end opposite the spike includes a threaded section that is used to screw or thread directly into the outer sole of the article of footwear. Manufacturing of the shapes of spikes that include SMA therein or associated therewith may include a combination of EDM machining and turning at cryogenic or hot-forming temperatures.

The present invention may include a method of disposing SMA elements in footwear, the method including embedding the SMA elements within a material or main body portion. The SMA elements may be tuned prior to the embedding step. The SMA elements may be tuned using a fixture. Tuning may include prestressing. The method may include the step of weaving fiber members around at least a portion of the SMA elements. The SMA elements may be disposed, associated with or may be formed as a plate that is associated with the footwear. The plate may be associate with a midsole of the footwear. The SMA elements may be disposed in or associated with one or more spikes or cleats associated with the footwear. A method of disposing SMA elements in footwear may include knitting, weaving or crushing the SMA elements together with non-SMA element components to create an SMA fabric. A method of disposing SMA elements in footwear may include defining a cavity within a portion of an article of footwear, delivering an SMA structure within the cavity and in a first position, and expanding the SMA structure to a second position such that the SMA structure exerts an outward force on at least a portion of the wall or surface of the cavity.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
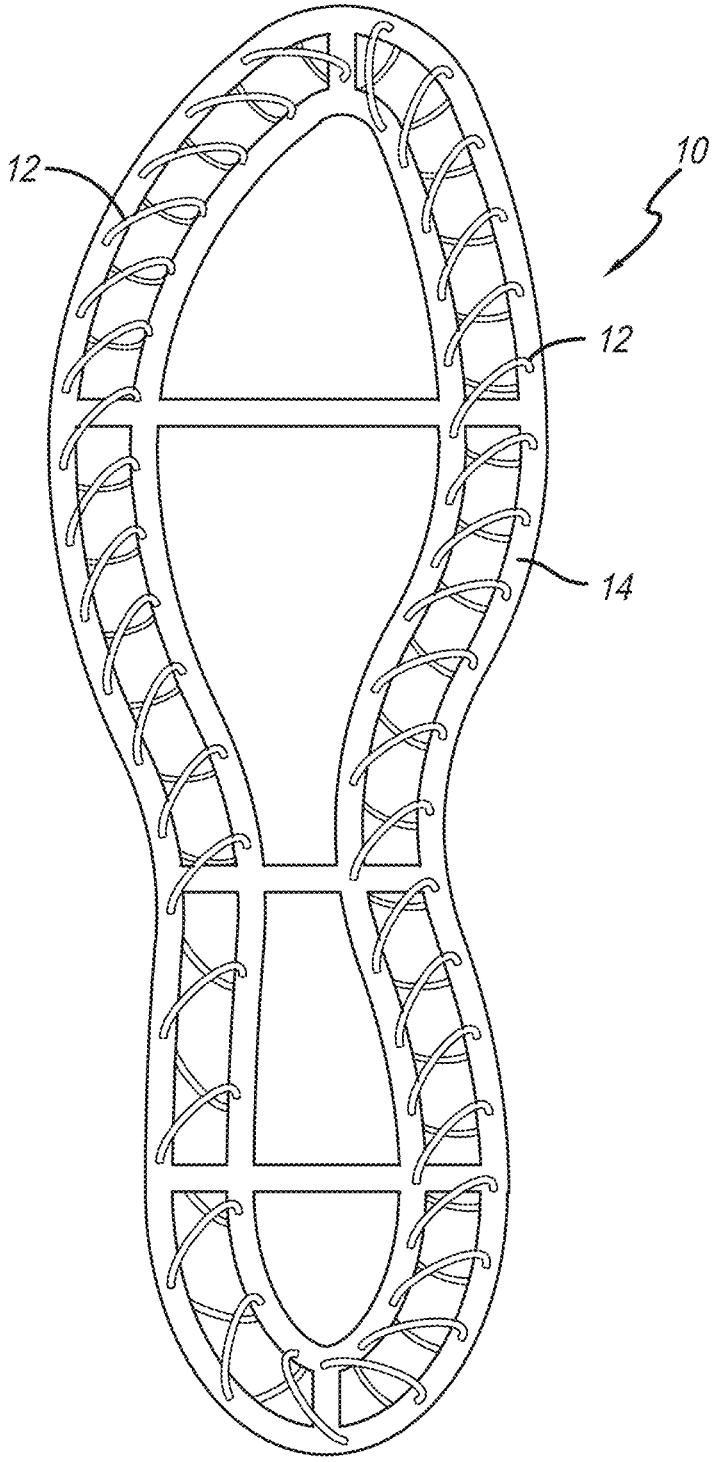
FIG. 1 is an top plan view of a frame assembly with SMA elements therein for use in a footwear assembly in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments. If a component is not shown in a drawing then this provides support for a negative limitation in the claims stating that that component is "not" present. However, the above statement is not limiting and in another embodiment, the missing component can be included in a claimed embodiment.

Reference in this specification to "one embodiment," "an embodiment," "a preferred embodiment" or any other phrase mentioning the word "embodiment" means that a particular feature, structure, or characteristic described in connection with the embodiment is included in at least one embodiment of thedisclosure and also means that any particular feature, structure, or characteristic described in connection with one embodiment can be included in any embodiment or can be omitted or excluded from any embodiment. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others and may be omitted from any embodiment. Furthermore, any particular feature, structure, or characteristic described herein may be optional. Similarly, various requirements are described which may be requirements for some embodiments but not other embodiments. Where appropriate any of the features discussed herein in relation to one aspect or embodiment of the invention may be applied to another aspect or embodiment of the invention. Similarly, where appropriate any of the features discussed herein in relation to one aspect or embodiment of the invention may be optional with respect to and/or omitted from that aspect or embodiment of the invention or any other aspect or embodiment of the invention discussed or disclosed herein.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward" and "below" used herein are merely for ease of description and refer to the orientation of the components as shown in the figures. It should be understood that any orientation of the components described herein is within the scope of the present invention.

The figures are generally directed to a footwear assembly, SMA assembly, sole assembly or footwear component that includes SMA elements therein. The present invention also may include one or methods for preparing or forming the SMA elements and/or forming the footwear assembly or a portion thereof.

FIG. 1 shows one or more or a plurality of SMA elongates or elements 12 contained within a frame member 14 and that may be utilized within a footwear assembly 10. The SMA elements can be used in any portion of the footwear or in any footwear component (e.g., a midsole). The frame member 14 is included for illustration purposes only to show the shape that the SMA elements may take within the footwear component (e.g., see FIG. 4 below). In another embodiment, the frame member 14 may be included within the footwear and/or may be used for holding the SMA elements in place during a forming or molding process. The SMA elements are made of a shape memory alloy structure that may include shape set SMA elongates.

Figure 2:
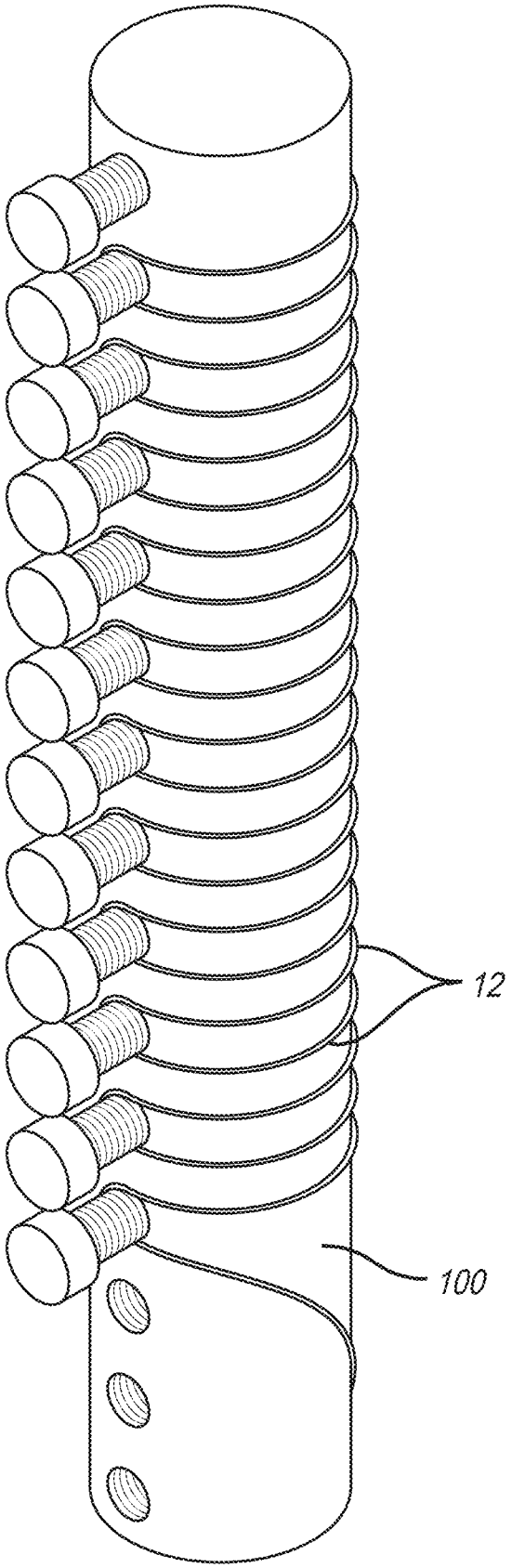
FIG. 2 shows a fixture used for constraining and shaping a SMA element.

In a preferred embodiment, to manufacture a SMA structure or element, SMA elements or elongates 12 may be constrained within a fixture 100, as shown in FIG. 2, and "shape-set" through annealing. Shape setting also stress relieves the material. The shape setting fixture 100 is carefully designed to constrain the SMA structure in the correct shape, and survive high temperatures during annealing. The exemplary fixture 100 includes threaded fasteners or other posts that can be used for shape setting and may be movable to adjust for different overall shapes of the SMA elements.

Figure 3:
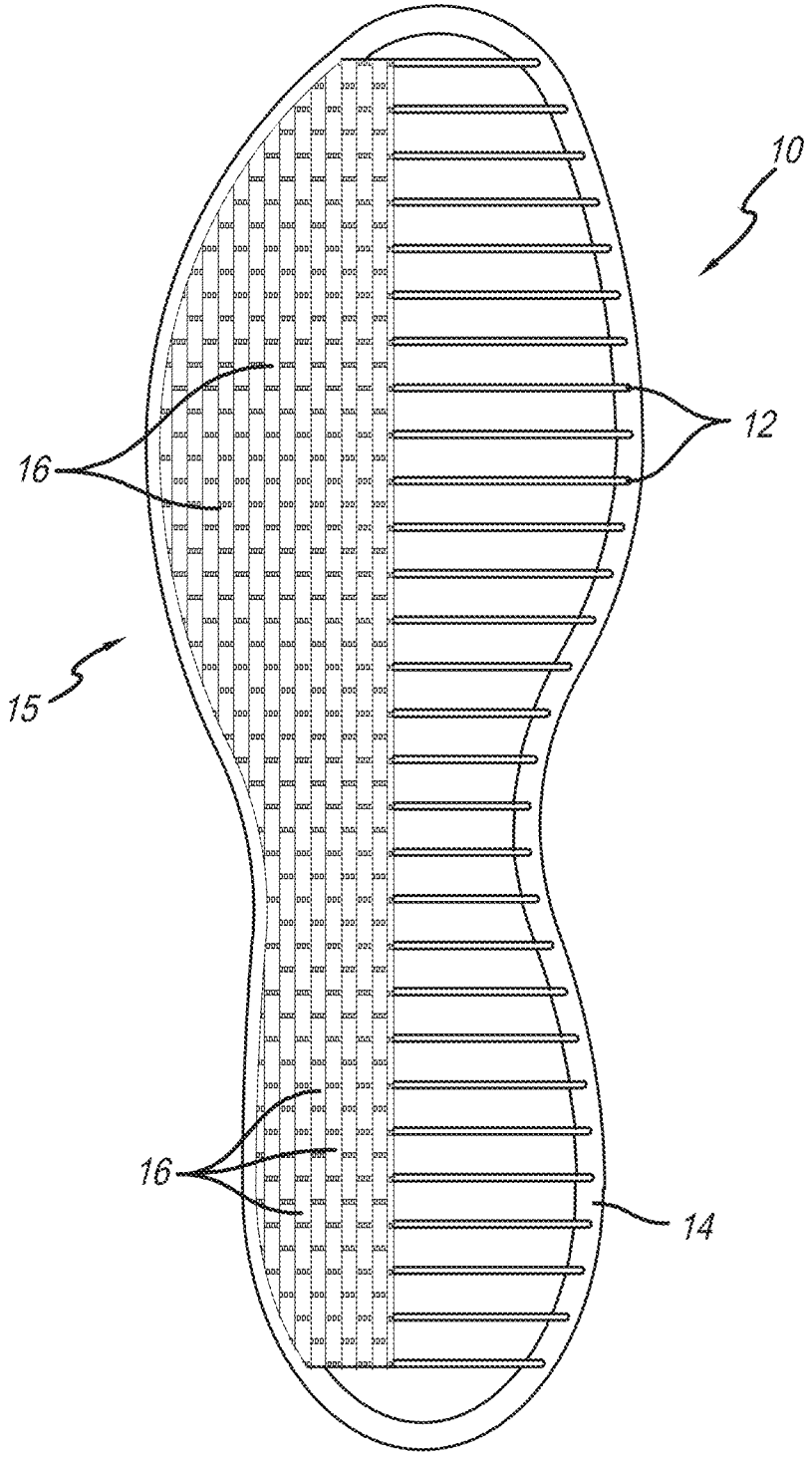
FIG. 3 is a plan view of a footwear component with SMA elements secured within a frame member and including interwoven fiber reinforcements around a portion of the SMA elements.

As shown in FIG. 3, the SMA structure or elements may be reinforced using an interwoven fiber reinforcement assembly 15 that includes a plurality of fibers members 16. FIG. 3 shows a footwear component 10 with SMA elements 12 secured within a frame member 14 and including interwoven fiber reinforcements or fiber members 16 woven around at least a portion of the SMA elements 12. It will be appreciated that the frame member 14 may not be included in the final footwear component, but may be included during the manufacturing process to maintain the SMA elements 12 in place as the fiber members 16 are weaved, knitted or otherwise secured therearound or thereto. The fiber members provide some added strength, lateral and shear stability, and promote strong adhesion during the subsequent encapsulation processes discussed below. The fiber members may comprise or be made of a material such as Kevlar, nylon, polyester or any fibrous material that allows a close weave, knit or the like around the SMA elements. FIG. 3 shows Kevlar fiber reinforcement members woven between the SMA structure. However, the present invention may also omit the fiber members.

Figure 4:
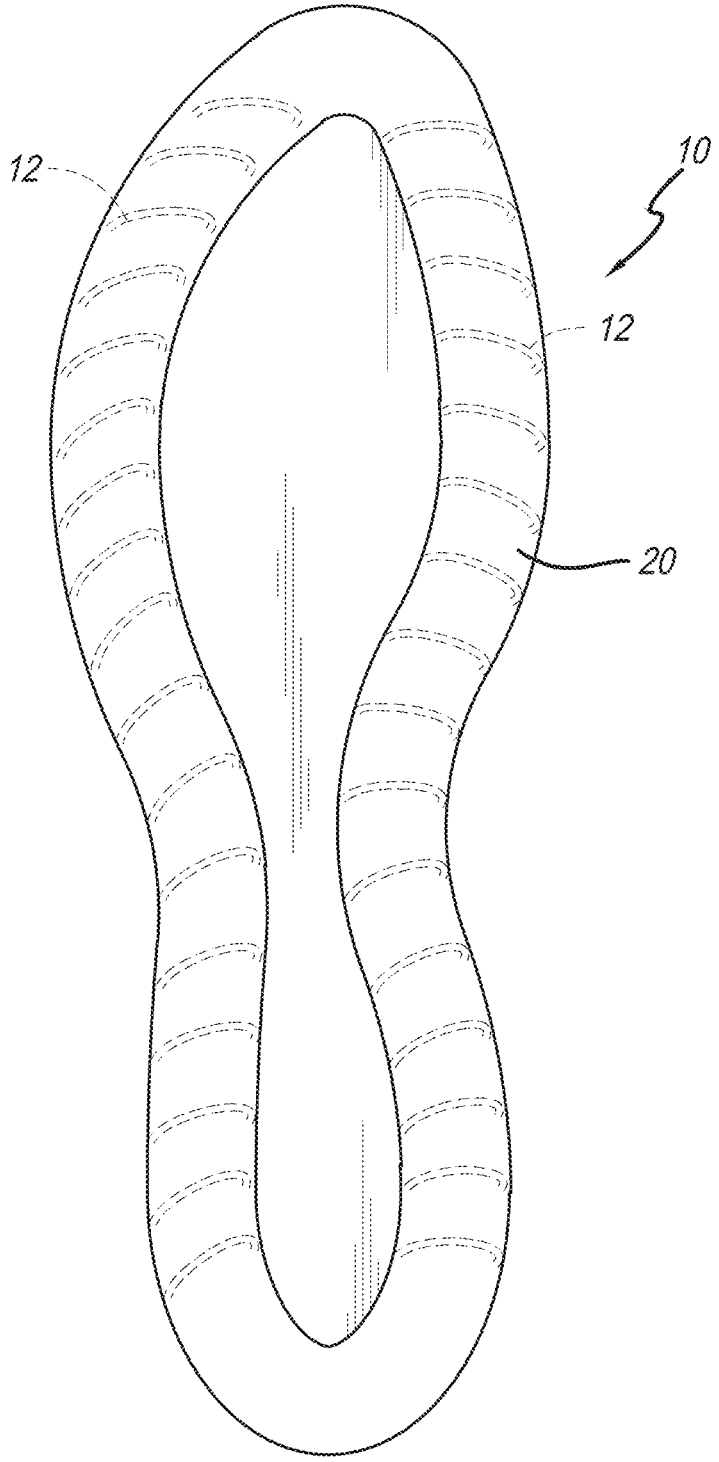
FIG. 4 is a bottom plan view of a footwear component with SMA elements embedded therein.

As shown in FIG. 4, the SMA structure(s) or elements 12 and possibly the interwoven fiber reinforcement members may then be encapsulated in a main body portion 20 that comprises a material and is shaped to the design of the footwear component. For example, the material of the main body portion may be made of a polymer compound (such as EVA, TPU, etc.) in either rubber or foam form. For encapsulation, a mold is prepared to fit the SMA structure 12. The one or more SMA elements 12 may be disposed in a mold, e.g., with two mold halves, that can be used to form, for example, a midsole. The mold may include a groove for fitting or receiving the SMA structure(s) 12. The material of the midsole or other footwear component is inserted/poured/injected into the mold for encapsulation of the SMA elements 12. FIG. 4 shows the footwear assembly 10 after removal from the mold, and includes the SMA elements 12 encapsulated at least partially within the main body portion 20. In an embodiment where fiber members 16 are included, the fiber members 16 are at least partially encapsulated or contained within the material of the main body portion 20. Hollow portions or areas can be formed in the main body portion (e.g., using roto molding or other techniques). U.S. Patent App. No. 2024/0116313 is incorporated by reference herein in its entirety.

Figure 5:
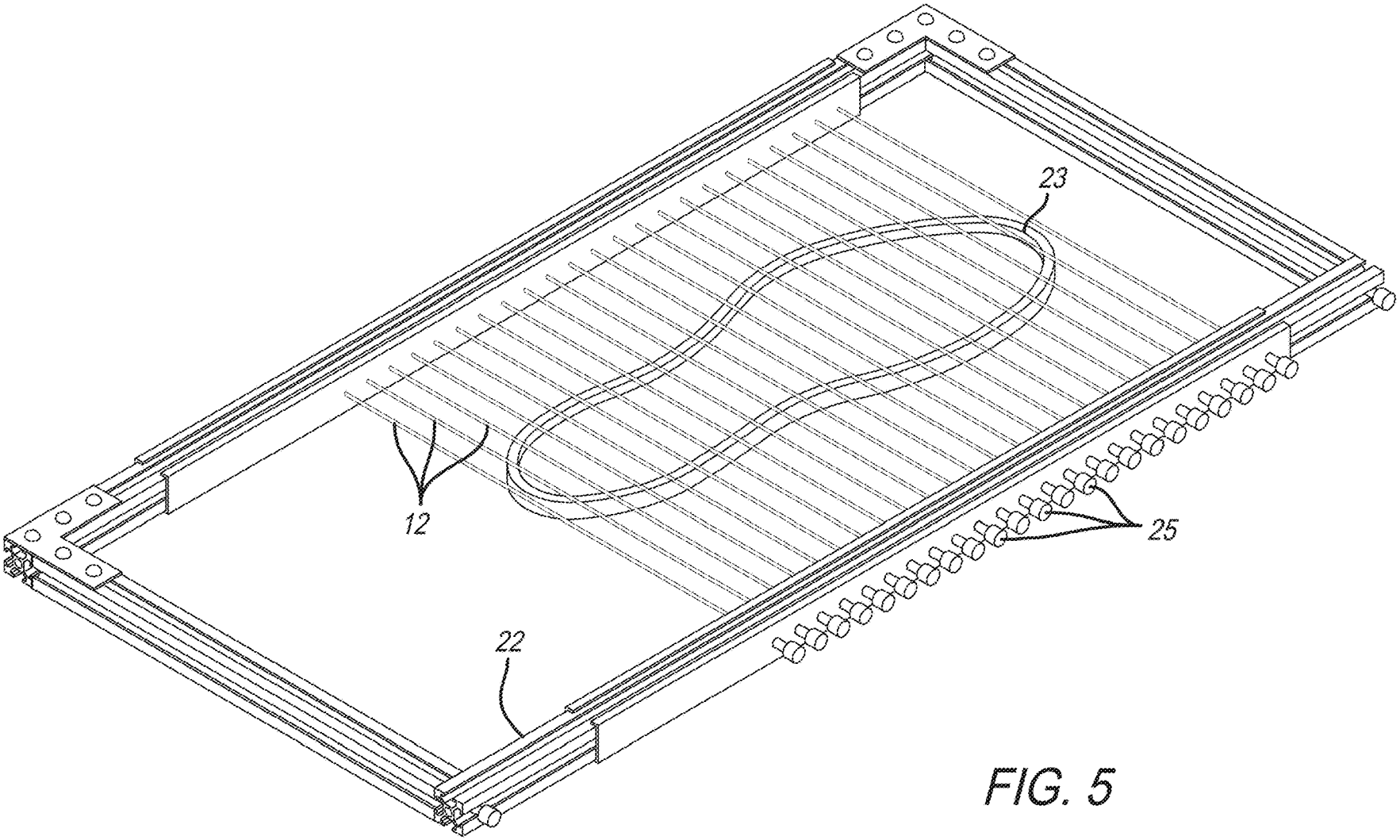
FIG. 5 is a perspective view of a fixture including SMA elements contained therein and positioned above a mold for creating a footwear component.
Figure 6:
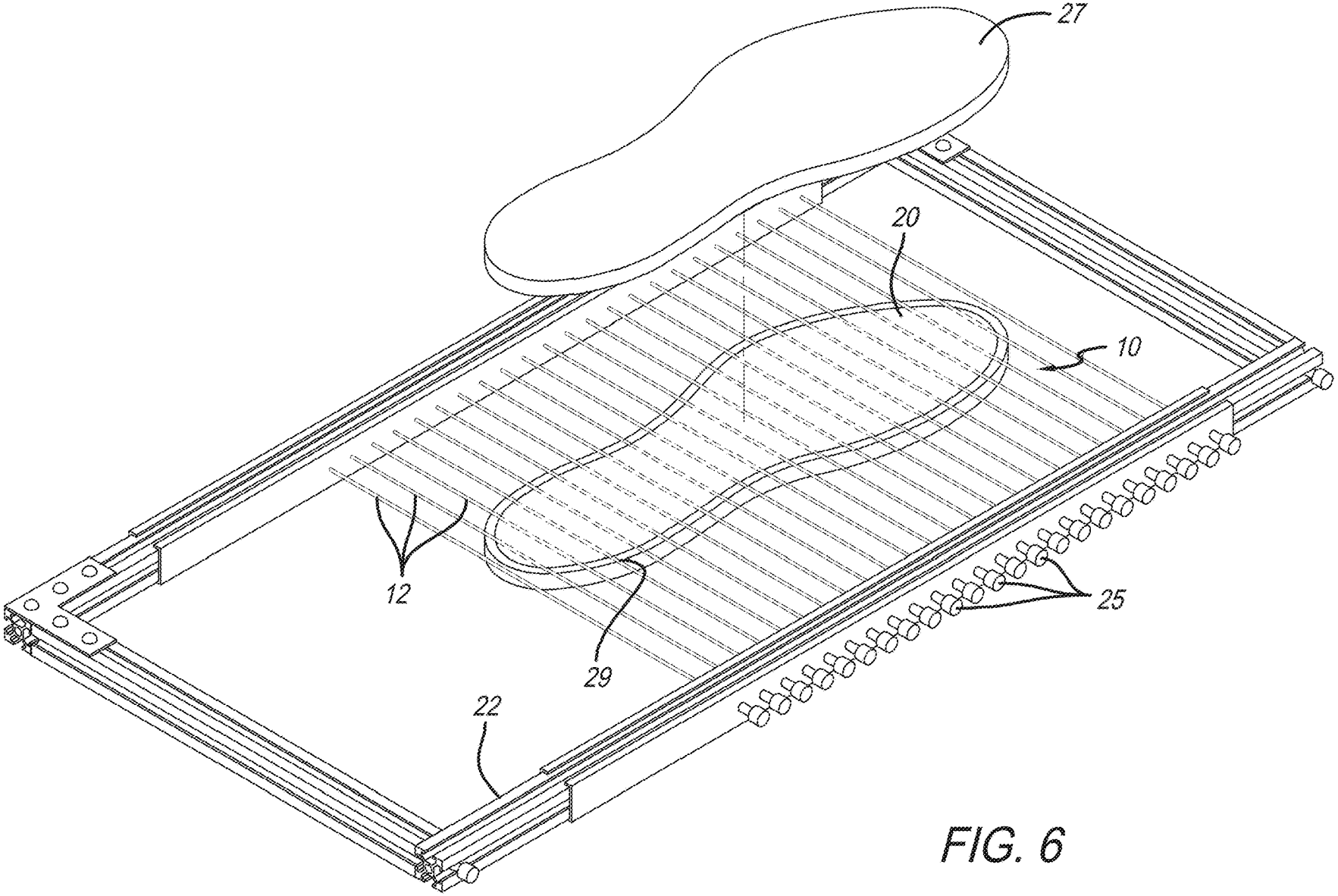
FIG. 6 is an exploded perspective view of two mold halves and the fixture of FIG. 5.
Figure 7:
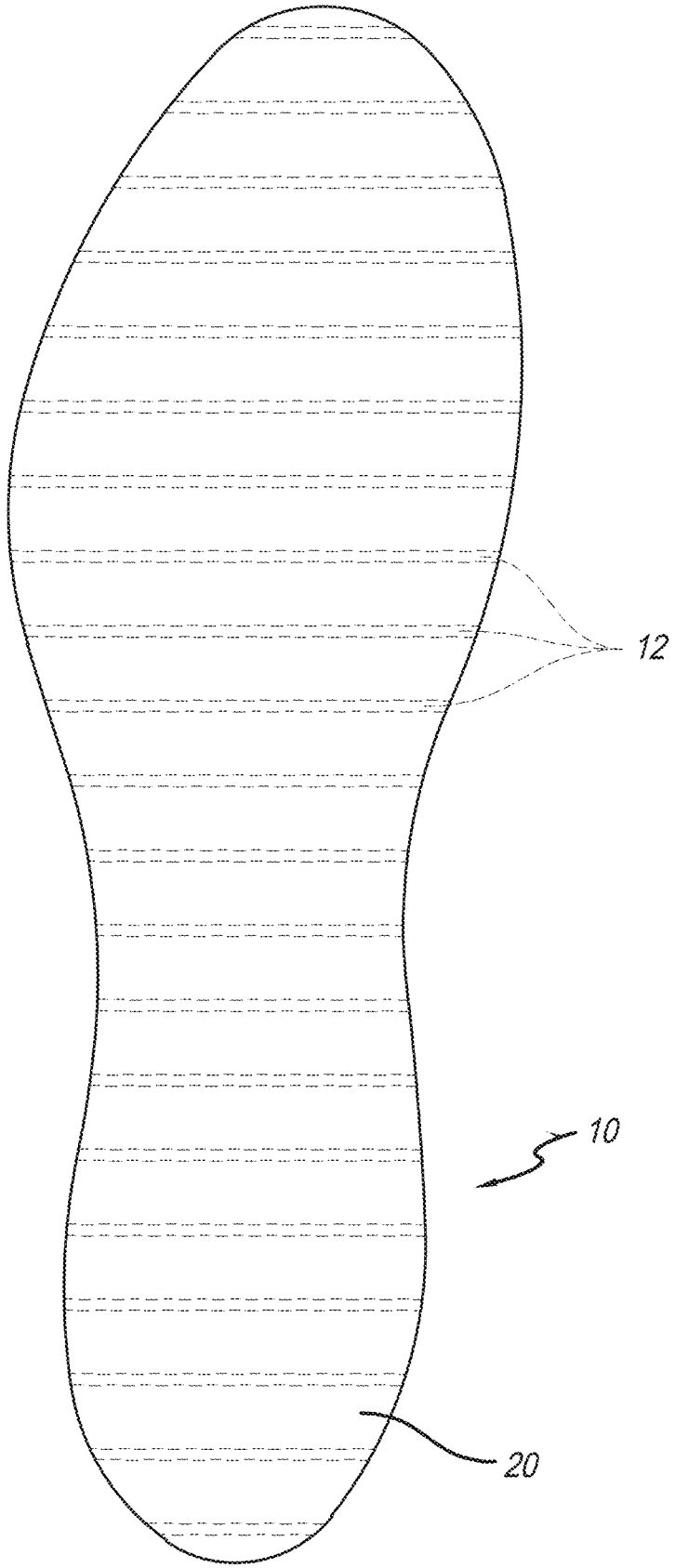
FIG. 7 shows the footwear component created using the fixture and mold of FIG. 5.

FIGS. 5-7 are directed to a method for pre-straining or pre-stressing the SMA elements 12 for inclusion, embedding or encapsulation within a shoe component or portion, such as an insole, which is referred to herein as an SMA assembly. Pre-stressing or pre-straining SMA can be used for a method for tuning the rebound and/or damping response of the SMA. FIG. 5 shows as a part of the method, the stretching of SMA elongates 12 in the longitudinal direction within a fixture. For example, see the fixture 22 shown in FIG. 5. The wires 12 are stretched in the fixture 22 over a mold bottom 23 that can then be filled with a material to encapsulate and lock in the pre-strain. In short, the SMA elements are tuned as desired via pre-stressing or pre-straining and then the SMA elements are constrained or secured in place by encapsulating the SMA elements at least partially within a material or main body portion to form the SMA assembly 10. The exemplary fixture 22 of FIG. 5 includes adjustment members 25 for tuning the SMA elements 12. The mold bottom 23 may include grooves 29 through which the SMA elements 12 extend and into the mold interior where the material 20 is poured. A secondary or encapsulation material is poured/injected over the pre-strained SMA wires to at least partially surround, embed and/or constrain the pre-strained SMA elements 12. FIG. 6 shows the material after molding and encapsulating the SMA elements 12 as they are still within the fixture 22 and mold bottom 23. Mold top half 27 is also shown. It will be appreciated that in the picture shown in FIG. 6 the top cover 27 of the mold has been removed and the material is still within the bottom half of the mold. FIG. 7 shows the SMA assembly 10 after removal from the fixture and the cutting of the SMA elements 12 that protrude from the main body portion 20. It will be appreciated that edge finishing can be applied to the edges or sides of the SMA assembly 10 (e.g., insole or layer) after the SMA elements are cut. In another embodiment, the SMA elements can be cut or sized prior to encapsulation.

Figure 8:
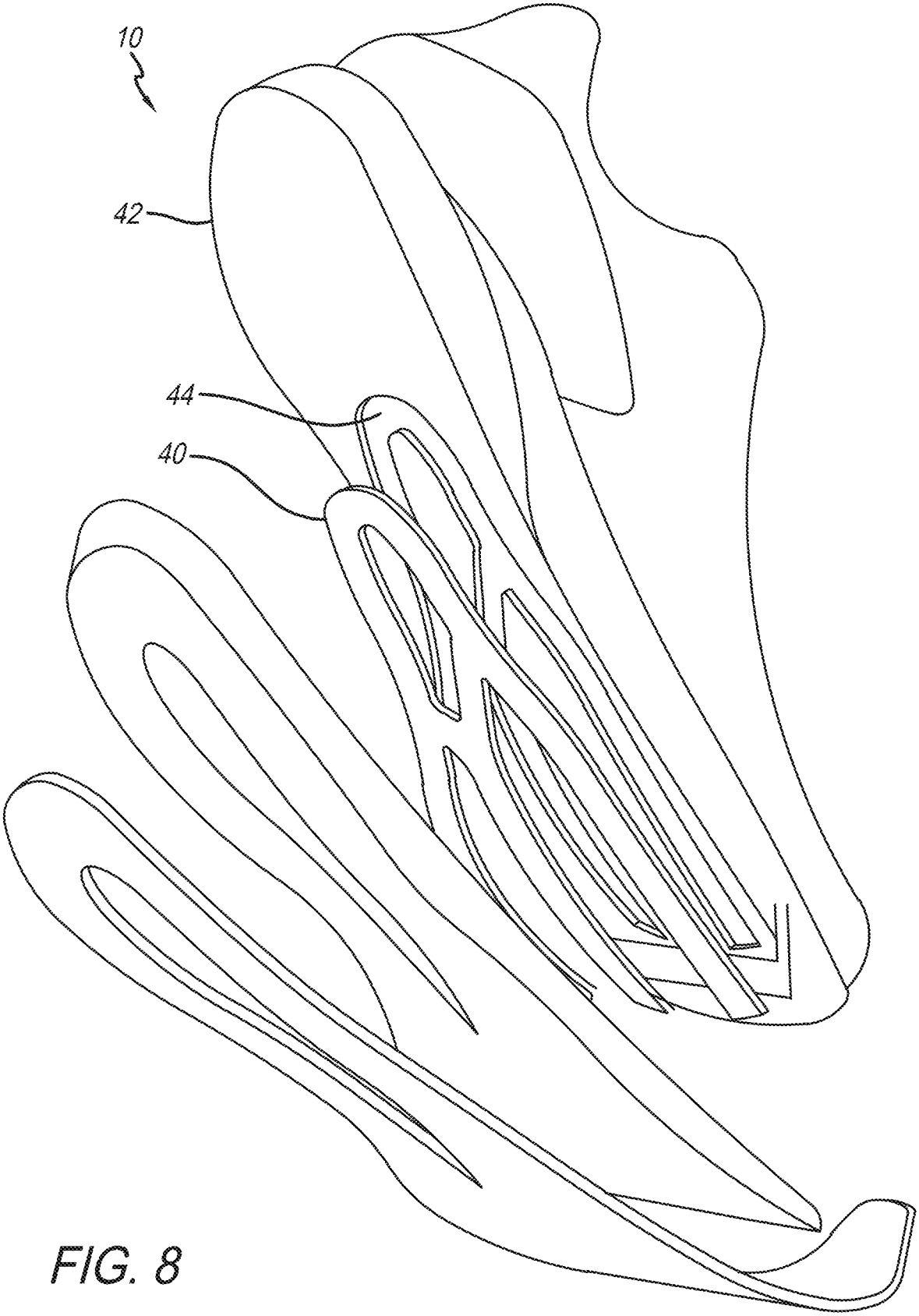
FIG. 8 is an exploded perspective view of a footwear assembly in accordance with a preferred embodiment of the present invention.

In a preferred embodiment, the present invention includes a plate that is integrated into the midsole 42 and/or insole of an article of footwear (or at or in any other location as part of the article of footwear). The plate includes SMA materials therein or is comprised thereof. FIG. 8 shows an exemplary article of footwear 10 with an SMA plate 40 integrated therein. The footwear may include an upper, insole, midsole and/or outer sole. One or more SMA plates may be disposed between or within any of the portions of the article of footwear. The semi-rigid plate 40 may be comprised mainly or as a majority of SMA. In another embodiment, the plate may be comprised 100% of SMA or of less than 50% SMA. Any percentage between 1% and 100% is within the scope of the present invention. Furthermore, the plate may take the shape shown in FIG. 8 or any other shape allowing it to be incorporated into an article of footwear. The midsole 42 or other footwear component may include one or more grooves or recesses 44 for receiving or housing the plate 40. It will be appreciated that there may be multiple possible embodiments of the plate and the SMA component(s) thereof. Any embodiment (or the components thereof) discussed herein is interchangeable with any of the other embodiments discussed herein.

The plate may comprise one or more SMA elongates, such as SMA wire, ribbon, tubing, etc. The elongates may be embedded in a semi-rigid resin (or other material) matrix to create or provide the plate or plate insert. The elongates may be shape set in a 3D configuration and then embedded into the material. In some embodiments, the SMA elongates may be reinforced with a secondary filament interwoven.

The plate may comprise one or more SMA sheets. Thin sheets of SMA may be formed and shape set in the final geometry. The SMA sheet may then be embedded or surface finished in another material and inserted in the footwear (as a part of the midsole or elsewhere within the article of footwear). SMA sheets may be formed and shape set from a combination of die presses, stamping, electrical discharge machining (EDM), thermal processing and/or other processes.

The plate may comprise one or more SMA chopped microfilaments. In this embodiment, SMA microfilaments may be chopped and pressed into a mold that is then filled with a semi-rigid resin (or other material) matrix. This may be a similar manufacturing method to carbon fiber plates made of chopped carbon fiber microfilaments. The SMA microfilaments may orient randomly, resulting in a more isotropic plate.

The plate may comprise one or more SMA fabrics, including wovens, knits, and meshes, that are manufactured from SMA elongates (microfilaments, yarns, wire, tubing, ribbon, etc). The SMA fabric is then formed and embedded in a semi-rigid resin matrix. Another possible manufacturing method is for 2D SMA fabric composites to be combined/stacked into a 3D configuration. The 3D geometry may then be shaved/grinded down to the final part geometry. This may be a similar manufacturing to many carbon fiber woven composites.

In some embodiments, the SMA structure (and possible interwoven fiber reinforcement) may then be encapsulated in a secondary material and shaped to the design of the footwear component. Secondary materials may be a semi-rigid resin (or other material) that is inserted, poured, injected or the like.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

Although the operations of any method(s) disclosed or described herein either explicitly or implicitly are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

The teachings of the disclosure provided herein can be applied to other systems, not necessarily the system described above. The elements and acts of the various embodiments described above can be combined to provide further embodiments. Any measurements or dimensions described or used herein are merely exemplary and not a limitation on the present invention. Other measurements or dimensions are within the scope of the invention.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. § 112, ¶6, other aspects may likewise be embodied as a means-plus-function claim, or in other forms, such as being embodied in a computer-readable medium. (Any claims intended to be treated under 35 U.S.C. § 112, 9 ¶6 will include the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. An article of footwear that includes an upper, a midsole and an outer sole, wherein the midsole includes an interwoven fiber reinforcement assembly, the interwoven fiber reinforcement assembly comprising a plurality of shape memory alloy elongate elements and a plurality of fiber reinforcement members woven around at least a portion of the plurality of shape memory alloy elongate elements, the plurality of fiber reinforcement members being composed of a non-shape-memory-alloy material.

2. The article of footwear of claim 1 wherein the plurality of shape memory alloy elements are shape set in an interwoven configuration within the interwoven fiber reinforcement assembly.

3. The article of footwear of claim 1 wherein the plurality of shape memory alloy elongate elements comprises at least three shape memory alloy elongate elements.

4. The article of footwear of claim 1 wherein the plurality of fiber reinforcement members provide lateral and shear stability to the plurality of shape memory alloy elongate elements.

5. The article of footwear of claim 4 wherein opposite ends of each of the plurality of shape memory alloy elongate elements are contained within a frame member.

6. The article of footwear of claim 4 wherein the interwoven fiber reinforcement assembly is at least partially contained within the midsole.

7. The article of footwear of claim 4 wherein the plurality of fiber members are comprised of Kevlar, nylon or polyester.

* * * * *